252-148 AU 157 EX
12/31/85 XR 4,561,993

United States Patent [19]
Choy et al.

[11] Patent Number: 4,561,993
[45] Date of Patent: Dec. 31, 1985

[54] THIXOTROPIC ACID-ABRASIVE CLEANER

[75] Inventors: Clement K. Choy, Walnut Creek; Barry A. Sudbury, Pleasanton, both of Calif.

[73] Assignee: The Clorox Company, Oakland, Calif.

[21] Appl. No.: 590,120

[22] Filed: Mar. 16, 1984

Related U.S. Application Data

[63] Continuation-in-part of Ser. No. 408,524, Aug. 16, 1982, abandoned.

[51] Int. Cl.[4] ..... C11D 3/12
[52] U.S. Cl. ..... 252/174.25; 252/128; 252/140; 252/145; 252/148; 252/173; 252/DIG. 14; 134/3; 134/40; 134/41
[58] Field of Search ..... 252/174.25, 142, 145, 252/148, 173, DIG. 14, DIG. 10

[56] References Cited

U.S. PATENT DOCUMENTS

| | | | |
|---|---|---|---|
| 2,257,467 | 9/1941 | Jacobson | 252/145 |
| 3,553,145 | 1/1971 | Butke et al. | 252/170 |
| 3,553,146 | 1/1971 | Butke et al. | 252/170 |
| 3,650,956 | 3/1972 | Strand et al. | 252/90 |
| 3,652,420 | 3/1972 | Hill | 252/101 |
| 3,839,213 | 10/1974 | Hill | 252/89 |
| 3,893,840 | 7/1975 | Wason | 106/288 B |
| 3,997,460 | 12/1976 | Sirine et al. | 252/106 |
| 4,067,746 | 1/1978 | Wason et al. | 106/288 B |
| 4,132,806 | 1/1979 | Wason et al. | 424/357 |
| 4,156,717 | 5/1979 | Wason | 424/49 |
| 4,240,919 | 12/1980 | Chapman | 252/95 |

FOREIGN PATENT DOCUMENTS

| | | |
|---|---|---|
| 1767992 | 10/1971 | Fed. Rep. of Germany . |
| 1193385 | 5/1970 | United Kingdom . |

OTHER PUBLICATIONS

PPG Industries, Inc., Hi-Sil ® T-600 Silica Thickener, 1981.
PQ Corporation, Performance Materials Bulletin Quso Products.
J. M. Huber Corp., Zeosyl 110 SD Properties Sheet, Nov. 1981.
Degussa Corp. Product Information Sheet, Sipernat 50S, Jul. 1983.
W. R. Grace, Davison Chemical Division, Syloid ® Silica Data Sheet.
Cosmetic Properties and Structure of Fine-Particle Synthetic Precipitated Silicas, J. Society of Cosmetic Chemists 29, pp. 497, 521 (1978).
Huber Corporation Brochure on Isothix 265.
W. R. Grace, Davison Chemical Division Brochure on Syloid, Jan. 1979.

*Primary Examiner*—Paul Lieberman
*Assistant Examiner*—Hoa Van Le
*Attorney, Agent, or Firm*—J. J. Hayashida; S. M. Westbrook

[57] ABSTRACT

A thixotropic cleaner comprising about 6 to 12% of a precipitated silica; about 0.05 to 2.5% of a cationic, nonionic or zwitterionic or amphoteric surfactant, or mixtures thereof, that has the ability to hydrogen bond and mixtures thereof; an acid; and an abrasive.

The relationship between the relatively narrow ranges of precipitated silica and hydrogen bonding surfactant is critical and responsible for the favorable viscosity, ability to suspend abrasives, and minimal or lack of syneresis. All of these advantageous characteristics are stable over an extended period of time.

17 Claims, 6 Drawing Figures

FIGURE I

THIXOTROPIC ACID-ABRASIVE CLEANER

This is a continuation-in-part application to co-pending U.S. application Ser. No. 408,524, filed Aug. 16, 1982, now abandoned.

BACKGROUND OF THE INVENTION

Stains that develop on hard vitreous surfaces, e.g., lavatories, tubs, toilets, etc., are often extremely difficult to remove. Where such stains develop because of the deposition of hard water salts, and/or iron residues combined with organic components (fecal and algal), removal can be especially difficult. Powdered abrasive cleansers have traditionally been used to treat such stains. However, in recent years, liquid or gel cleaners have been especially developed for removal of such stains; and most usually such cleaners, along with customary surfactant and detergent components, incorporate relatively strong acid and abrasive components. The acid component is quite useful in attacking the hard water components of the stain and helps in hydrolyzing the organic matter. The abrasives, with the aid of a scrubbing action, are effective in physically removing the stains from the surface. Together, the detergents and surfactants, along with the acids and abrasives, can be quite effective in cleaning such stained surfaces.

One example of a thickened cleaner is disclosed in U.S. Pat. No. 3,997,460 issued Dec. 14, 1975 to Sirine et al. The referenced patent describes a thickened abrasive cleaner which is effective for removing stains on hard surfaces. The product includes a mineral acid as well as an abrasive suspended in the cleaner to aid in the mechanical removal of stains. The formula utilizes fumed silica as a thickening agent and is contended to suspend the abrasive particles in the liquid components over extended periods of time.

The disadvantages of cleaners such as the Sirine et al cleaner are at least twofold. It is difficult to maintain a desirable viscosity which is also capable of suspending abrasives. It is also difficult to produce a cleaner which little or no syneresis, i.e., whose liquid components do not substantially separate from the solid components in the cleaner.

As an example of the first disadvantage, one difficulty with the Sirine et al composition is the development of increasing viscosity as the product ages. Such formulations become increasingly more viscous as they sit on the shelf—and, in fact, eventually become so viscous that they gel. Then they are no longer able to be poured or squeezed from their containers. Such products therefore have a poor "shelf" life, and for that reason have not been commercially exploited. Such compositions utilized fumed silica thickening components, but the undue thickening occurs even where the fumed silica is present in the range of about 1–5% by weight. At the upper 5% limit, increased thickening occurs very rapidly and the product soon "sets up" into the aforementioned rigid "gel". On the other hand, as shown below, 5% or less precipitated silica provides little viscosity and will result in a thin product.

An example of the second problem, i.e., preventing or minimizing syneresis (somewhat the opposite problem from undue thickening), may also be depicted by the Sirine et al composition. Sirine et al shows only the use of fumed silicas and only at levels of 5% by weight or less of the total composition. If a precipitated silica, which Sirine et al contend can be used in place of fumed silica, is used at such low levels, only thin, syneretic compositions result which are incapable of suspending abrasives, have poor viscosity and will no adhere to vertical surfaces. Syneresis may be observed to occur at levels as high as 50%. Further, nothing within Sirine et al indicates that the amounts of surfactant combined with the precipitated silica are critical to obtain an acceptable product.

Therefore, Sirine et al do not teach how to make either a cleaner which, upon storage will not set up or harden, or make a cleaner which avoids the opposite problem, i.e., thin, watery compositions which are unable to suspend abrasives. U.S. Pat. No. 2,257,467 issued Sept. 30, 1941 to Jacobson et al., describes a somewhat similar cleaning composition wherein silica is utilized along with a strong acid to provide a gel-like acid paste cleaner useful for cleaning hard surfaces. The product however is a paste of jelly, and contains no surfactants or abrasives.

Accordingly, the present invention is directed to cleaner compositions having desirable viscosity and minimal or no syneresis, which are capable of stably suspending abrasive particles. The inventive compositions additionally maintain these advantageous characteristics over an extended period of time. These cleaners will adhere to vertical surfaces because of their thixotropic characteristics and can provide good cleaning and high germicidal activity.

BRIEF SUMMARY OF THE INVENTION

The invention provides a thixotropic hard surface cleaner composition comprising about 0.05 to 2.5% of at least one hydrogen bonding surfactant combined with about 6 to 12% of a precipitated silica, an acid, an abrasive, and water.

The relationship between these relatively narrow ranges of surfactant and precipitated silica is critical. It is the means by which the excellent viscosity, minimal or lack of syneresis, ability to suspend abrasive particles, and desired thixotropic characteristics of the inventive hard surface cleaners are achieved.

The relationship has led to the surprising results demonstrated further within this disclosure. This is namely, that one would be unable to produce a cleaner displaying these favorable viscosity, syneresis, suspensory and thixotropic characteristics by resorting to any of the teachings of the prior art.

The cleaners of this invention will have the basic amounts of ingredients disclosed below:

1. at least one hydrogen bonding, cationic, nonionic, zwitterionic, or amphoteric surfactant, or mixtures thereof, in the range of from about 0.05 to 2.5% by weight;
2. a thixotropic and abrasive suspending agent consisting of very high structure precipitated silica in the range of about 6% to 12% by weight;
3. a mineral acid, e.g., hydrochloric acid, in an amount from about 0.05 to 20% by weight of the composition;
4. a finely-divided, inert abrasive material, e.g., sand, in an amount from about 1 to 15% by weight; and
5. water.

It is therefore an object of the invention to provide a cleaning composition that includes an abrasive stably suspended in the liquid components but wherein a minimal amount of syneresis is exhibited.

It is a further object of the invention to provide a cleaning composition that retains a predetermined viscosity over extended periods of time and under rigorous temperature conditions.

It is a still further object of the invention to produce a cleaning composition that is strongly acidic and at the same time contains abrasives for the mechanical removal of stains.

It is another object of the invention to provide a cleaning composition that exhibits thixotropic properties.

It is yet another object of the invention to provide a thickened abrasive cleaner containing high amounts of cationic surfactant so as to have excellent germicidal properties.

BRIEF DESCRIPTION OF THE DRAWINGS

The manner in which the foregoing and other objects are achieved in accordance with the present invention will be better understood in view of the accompanying drawings which form a part of the specification and wherein.

DETAILED DESCRIPTION OF THE INVENTION

Figure 1:
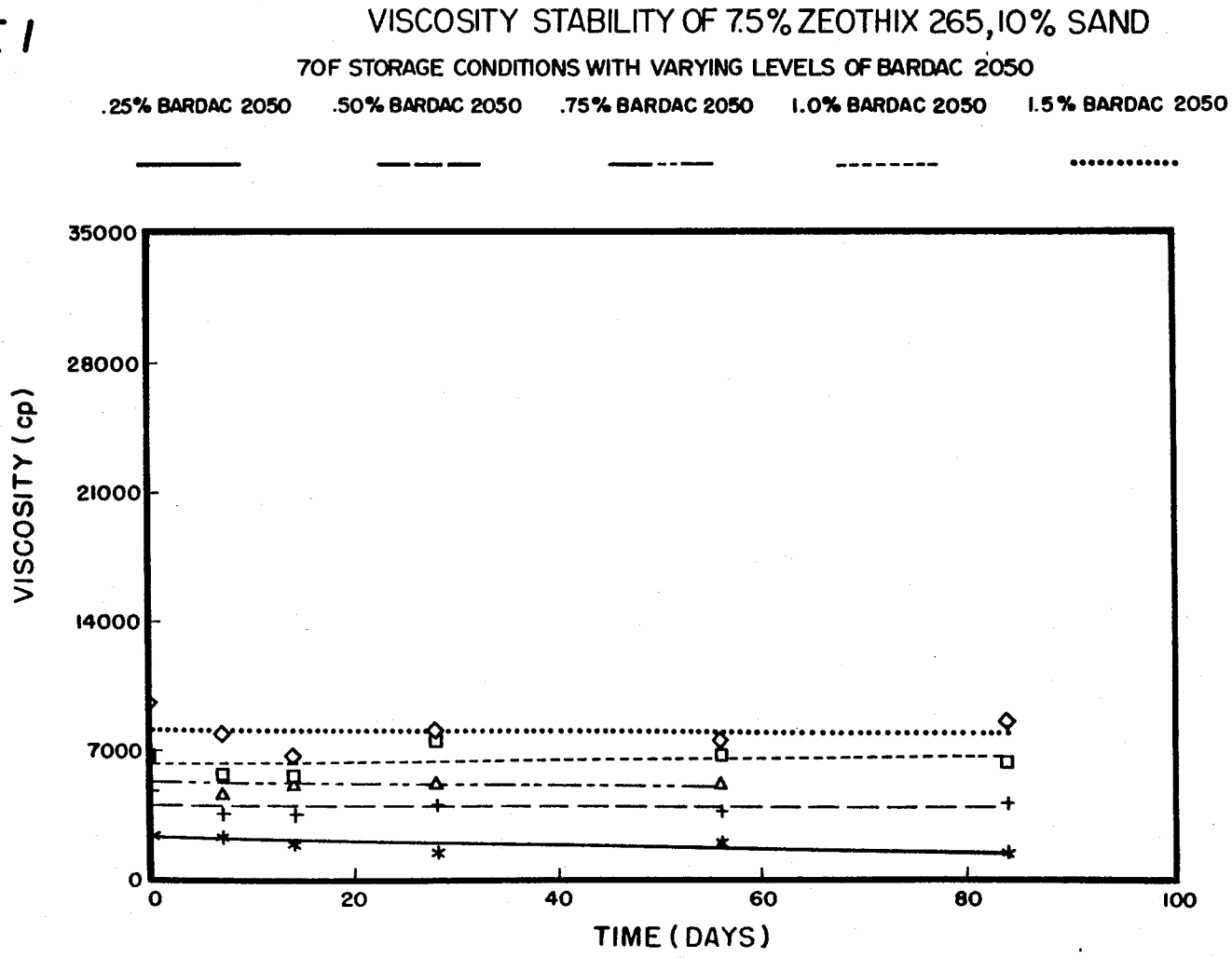
FIG. 1 is a graph showing the viscosity stability with time and at 70° F. of a composition of 7.5% precipitated silica (Zeothix ®) thickening agent and 10% abrasive, in combination with varying amounts of the preferred quaternary surfactant.

The cleaner of the present invention is a thixotropic acid-abrasive cleaner useful for removing stains on hard surfaces such as lavatories, toilets, tubs and the like. The various components of the cleaner are selected to produce a thixotropic composition, i.e., one that remains a thick fluid when standing but which turns relatively liquid upon agitation. The cleaner of the present invention also maintains the abrasive particles suspended therein over long periods of time with a minimum amount of syneresis, i.e., separation of the liquid from the gel phase.

The effectiveness of such cleaners is enhanced if the cleaner material can remain in contact with the stained portion over extended periods of time. However, such stains very often occur on inclined or vertical surfaces. Liquid cleaners drain very quickly from such surfaces whereby their effectiveness is greatly reduced.

Therefore, attempts have been made to produce thickened and/or highly viscous liquid cleaning formulations which will adhere to inclined or vertical surfaces until physically wiped away. It will be recognized that such cleaners must be relatively viscous in order to adhere to the vertical surfaces. On the other hand, it is quite desirable to apply such liquid cleaners by spraying from a squeeze bottle or other similar container. In highly viscous formulations, it may be necessary to apply considerable pressure to force the viscous material from a squeeze bottle nozzle. Thus, a careful balance must be maintained to produce a relatively thick viscous adherent cleaner which, at the same time, may be applied from a squeeze container without undue effort by the user.

One particularly effective solution to the above problem is to formulate such acid-abrasive cleaners in the form of a thixotrope. A thixotropic composition will exhibit the property of becoming relatively fluid when agitated or shaken, but turns very viscous and gel-like when standing and undisturbed. Such thixotropic properties would appear, therefore, to be quite desirable for a cleaner composition useful for the purposes stated herein.

An additional desirable property of such a thixotropic cleaner would be the ability to suspend the abrasive particles for long periods of time without separation, i.e., have a low syneresis. Thus, it would not be necessary to agitate such cleaners prior to application for the purpose of resuspending any abrasive particles which might normally separate out upon standing.

Therefore, the production of a acid-abrasive containing cleaner in a thickened, or thixotropic, form would be quite desirable for the purposes stated herein.

The viscosity of the inventive cleaner is such that it is sufficiently viscous to suspend abrasive particles uniformly throughout the cleaner. To provide an effective consumer product, this viscosity should be stable over a long period of time. Also, viscosity should be sufficient to cause the cleaner to adhere to a smooth vertical surface where hard water, iron and/or organic stains might be found inside of a toilet bowl, lavatory, tub, etc. The adherence of the cleaner to the vertical surfaces is important since the mineral acid present can most effectively attack the hard water and/or iron salts comprising a portion of the stains. In addition, the high viscosity keeps the abrasive agent adjacent to the stains and available for scrubbing contact therewith.

The thixotropic cleaner will effectively suspend the abrasive particles within the body thereof over extended periods of time when stored and awaiting use. When desired, the container may be gently shaken several times to induce the thixotropic liquefaction of the cleaner whereupon it may be squeezed from an orifice provided in the container onto the stained surfaces.

The selection of an agent to help provide these thixotropic and thickening-suspending characteristics is of vital importance to the cleaners of the invention. These agents are the precipitated silicas.

The utilization of silicas for thickening purposes has been noted in the prior art. See, for instance, the Sirine et al. U.S. Pat. No. 3,997,460 referred to previously. Such prior art thickened cleaner compositions, however, tend to become increasingly thicker and more viscous with time. In fact, they eventually may become so thick as to be unpourable and cannot undergo any reasonable amount of thixotropic liquidification upon normal shaking. Such compositions customarily have utilized fumed silicas as co-thickening agents along with xanthan gums and clay.

It might be expected that the use of any finely-divided silica product might effectively thicken a composition such as those utilized in the present invention. In fact, silicas may thicken such compositions under certain conditions. However, problems of hardening (with fumed silicas, as in Sirine et al patent) or lack of viscosity may easily result with the prior art cleaners.

Quite surprisingly, it has been determined that a particular silica product, i.e., very high structured precipitated silica, is especially capable of thickening compositions of the present invention but must be in combination with a hydrogen bonding surfactant in the mentioned critical amounts. These inventive compositions containing the precipitated silica and hydrogen bonding surfactants effectively produce desirably thixotropic cleaners which avoid the two undesirable results which the Sirine et al cleaners give: (1) when using up to 5% *fumed* silica, viscosity increases so greatly over time as to result in a hardened, nonflowable product and (2) when using only up to 5% *precipitated* silica, or more without respect to the surfactant level, a thin, watery, syneretic composition may result which is incapable of suspending abrasives.

It is even more surprising to note that the present compositions produce readily pourable compositions even when the product contains the thickening precipitated silica agent at levels up to 12% by weight depending also upon the amount of hydrogen bonding surfactant present. By contrast the mentioned Sirine patent formulations are limited to fumed silicas at levels of 5% maximum, at which lower concentration levels, such formulations eventually "set up" and become extremely difficult to remove from their containers. By contrast, if precipitated silicas are utilized at such low levels, no thickening will occur no matter how much surfactant is used, and a thin, watery composition results which will be incapable of suspending abrasives.

Experiments led to the surprising discovery that the mentioned relationship of silica and hydrogen bonding surfactant with respect, to their amounts in these compositions were critical. As discussed, the silica may be present in amounts from 6 up to 12%. However, amounts *less than* 6% have been found unacceptable for use. Concommitantly, the surfactant must not exceed about 2.5% and not be less than about 0.05% by weight. Within the 6–12% range for silica and the 0.05–2.5% range for surfactants the desired thixotropic, viscosity, nonsyneretic and suspending properties of the invention are shown.

The critical silica component is a precipitated silica. Most preferably the precipitated silica is of the "very high structure" type. The very high structure precipitated silicas are the most efficient in producing viscosity stable suspensions with minimal syneresis. Among these silicas are synthetic precipitated silicas made by proprietary processes (J. M. Huber Corp.) to control their internal structure. The preparation and physical characteristics of this class of silicas is noted in U.S. Pat. Nos. 3,893,840; 4,067,746; 4,132,806; and 4,156,717.

The preferred synthetic precipitated silicas include three very high structure precipitated silicas, namely, Zeothix ®265, Sipernat ®283LS and HiSil ®T-600.

Zeothix ®265, manufactured by J. M. Huber Corp., Havre de Grace, Md., is a precipitated silica prepared in an aqueous medium and has its surface fully hydroxylated. It has a silanol group density of 8 to 10 groups per square nanometer which results in a surface that is relatively more polar than fumed silicas. It is a white powder that has a pH (5% aqueous solution) of between 6.5 and 7.5; a bulk density of between 5 and 7 pounds per cubic foot; a density at 25° C. of 2.0 grams per milliliter; an average aggregate size of 1.5 to 2.0 microns (Coulter Counter Method); a refractive index of 1.45 to 1.46; and a surface area (BET) of from 250 to 300 $m^2/g$. As noted above, other similar very high structure precipitated silicas produced by related processes may be substituted for Zeothix ®265.

Sipernat ®283LS, manufactured by a joint venture between P.Q. Corporation, Valley Forge, Pa. and Degussa A. G., West Germany, is another precipitated silica prepared in an aqueous medium. It has a compacted apparent density of 130 grams per liter (DIN 53194 or ISO 787-11). It is a white powder that has a pH (5% aqueous solution) of about 8.3 It has a wet sieve residue at 45 microns of about 0.06%. It has a surface area (BET) of about 180 $m^2/g$.

HiSil ®T-600, manufactured by P.P.G. Industries, Inc., of Pittsburgh, Pa., is another ultra fine, white powder. This amorphous, synthetic silicon dioxide is produced by wet process, and has a pH (5% in water at 25° C.) of 7.0, silanol group density of 8–12 hydroxyl group per square micron, bulk density of 3–4 lbs./ft.$^3$, specific gravity of 2.1, wet sieve residue of 0.002% (at 325 mesh), and a surface area (BET) of 150 $m^2/g$.

The three next precipitated silicas suitable for use are Quso ®G-32, Quso ®G-30 and FK 500 LS.

The Quso ® series of precipitated silicas formerly manufactured, but now discontinued, by P.Q. Corporation, Valley Forge, Pa., were appropriate for use in the compositions of this invention if the appropriate critical ranges of surfactant and silica were obeyed. Most appropriate was Quso ®G-32 hydrophilic silica. This was an ultra fine white powder, with a pH (2.5% deionized water) of about 8.5, an agglomerate diameter (mean) (Coulter Counter Method) of about 1 to 1.5 microns, a refractive index of 1.45, and a surface area (BET) of about 300 $m^2/g$. Less preferred, but having acceptable results, was Quso ®G-30 hydrophilic silica. This was an ultra fine white powder, with a pH (2.5% in deionized water) of about 8.5, an agglomerate diameter (mean) (Coulter Counter Method) of about 1 to 2 microns, a refractive index 1.45, and a surface area (BET) of about 300 $m^2/g$.

FK 500 LS, manufactured by a joint venture with P.Q. Corp. of Valley Forge, and Degussa A. G., West Germany, is yet another precipitated silica with a pH (5% aqueous solution) of about 7, a wet sieve residue of about 0.02 (DIN 53580 or ISO 787-18), about 99% silicon dioxide groups, with a surface area (BET) of about 450 $m^2/g$.

Much less efficient, although, if used in critical amounts with the critical ranges of surfactant disclosed in the invention, marginal for use, are silicas such as Zeosyl ®200, manufactured by J. M. Huber, Silcron ®G-100, manufactured by SCM Corp., Baltimore, Md., and Syloid ®FP Silica Gels, manufactured by W. R. Grace & Co.'s Davison Chemical Division, Baltimore, Md., all of which appear not to be very high structure precipitated silicas. All, however, were found to be suitable for suspending abrasives, even if their viscosities were not as good, and the suspensions are more syneretic than those using the very high structure precipitated silicas.

Zeosyl ®200, manufactured by J. M. Huber, Corp., Havre de Grace, Md., is a hydrated, amorphous silicon dioxide powder. It has a pH (5% aqueous solution) of about 6.5 to 7.5, an average particle size of about 12 to 14 microns (Coulter Counter Method), a density at 25°

C. of 2.0 g/ml and a surface area (BET) of about 120 to 150 $m^2/g$.

Syloid ®FP silica gels, manufactured by Davison Chemical Division of W. R. Grace, Baltimore, Md., come in a wide range of surface areas (300 $m^2/g$ to 700 $m^2/g$), and oil absorption values (up to 300 grams per 100 grams Syloid ®FP silica). Exemplary is Syloid ®244 FP, having an average particle size of 4 microns, and a pH (5% aqueous slury) of 7.0, an average pore diameter of 200 angstroms, and a surface area (BET) of about 310.

Silcron G-100, manufactured by Glidden Pigments Group of S.C.M. Corp., Baltimore, Md., is another amorphous silica having a specific gravity of 2.1 (salt powder: 0.11), a melting point of 1600° C., and a pH (5% solution) of 7 to 8.

The precipitated silica is present in the cleaner compositions in an amount from somewhat more than 6% to somewhat less than 12% by weight; however, most preferably from about 7 to 8.5%.

As previously mentioned, surfactants are necessary to combine with the precipitated silicas in the critical amounts discussed to obtain the desirable characteristics of this invention. They also, of course, impart cleaning properties to the compositions.

Any surfactant capable of a reasonable level of association with the silica in acidic solution is acceptable. Preferred surfactants are cationic, nonionic or zwitterionic in character. Surfactants which are solely anionic do not work. While not wishing to be bound by any one theory, applicants believe it is important that the preferred surfactant types have polar moieties capable of hydrogen bonding contained in their molecular structure since this promotes the correct kind of association with the surface silanol groups on the silica particles. Once in place the hydrophobic tail of the surfactant modifies the nature of the silica surface in such a way that the silica particle themselves tend to associate and forms viscosity building structure. Anionic surfactants do not promote this type of silica structure building.

About 0.05 to 2.5% by weight surfactant is included in the compositions. It is preferred, however, to have from about 0.25 to 1.0% surfactant. When cationic surfactant is used, any of the common commercial quaternary salts, e.g., Bardac 20, available from Lonza Inc. of Fair Lawn, N.J., are particularly desirable as the surfactant component.

Bardac 20 is a quaternary ammonium surfactant with dialkyl ($C_8/C_{10}$-50%, $C_8/C_8$-25%, $C_{10}/C_{10}$-25%) dimethyl ammonium chloride. These ammonium chlorides are sold as an aqueous-alcohol solution. Thus, Bardac 2050 is a 50% solution of the above-noted Bardac 20 salts in water and alcohol, while Bardac 2080 is an 80% solution. Not only do such quaternary salts provide an effective cleaning action, but they also have desirable disinfectant properties.

While the cationic quaternary surfactants are most preferred, other surfactants which are also capable of hydrogen bonding with the silica may be substituted. For instance, nonionic surfactants of medium or high HLB values are useful. The common commercial poly-(oxyalkylene) alcohols such as those of the alkylphenoxy polyethoxy ethanols, e.g., the Tritons, available from Rohm and Haas of Philadelphia, Pa., are quite suitable. Other nonionics, such as the polyethylene glycol ethers of fatty alcohols, e.g., the Neodols available from Shell Chemical Co., may also be substituted into the formulations. Amine oxides, and zwitterionic surfactants may also be used. Mixtures of cationics and nonionics have proven very suitable.

The amount of surfactant present in the formulations must fall within the range of about 0.05 to 2.5% by weight as previously noted. The most preferred range is from about 0.25 to 1.0%. It is important that the concentration of the surfactant remain within the desired ranges. If the concentration is too low, insufficient thickening occurs and the abrasive may settle out. If the concentration of surfactant is too high, surprisingly severe syneresis is observed, and the viscosity actually drops dramatically. Thus, an addition of the quaternary surfactant over 2% will result in an unacceptable product, with lack of thickening sufficient to suspend abrasives, and inability to adhere to vertical surfaces. In this regard, viscosities in the range of from about 7,000 to 15,000 cps (Viscosities referred to herein are those measured with a Brookfield Viscometer, model LVT, equipped with a Helipath stand, at 6 rpm Spindle T-D.) are ideal for the thixotropic compositions of the invention. However, formulations having viscosities within the range of about 4,000 to 20,000 cps are useable; although in the lower and upper ranges, added shaking may be necessary to fully resuspend the abrasive, or to liquify the thixotrope. At these viscosities, the composition may be readily squeezed from the container, but will, at the same time, adhere quite well to vertical surfaces.

Additionally, the compositions of this invention show surprisingly minimal or no syneresis. Syneresis is defined as the separation of solid and liquid components of a suspension into discrete phases. The compositions of this invention have optimal syneresis values of no greater than about 20%, more preferably, no more than about 15%, most preferably no more than about 12% syneresis. Percentage syneresis is defined and measured as the percent of watery layer above the composition placed inside a container, e.g., a 250 ml beaker.

It is preferred that the relative amounts of surfactant and thickening agent may be varied within the indicated ranges to adjust the viscosity of the compositions to the desired value. Increased amounts of surfactant may be offset by decreased amounts of thickener; and vice versa, but only so long as the mentioned critical ranges are not exceeded.

It is also desirable to utilize a *mineral acid* in the compositions of the invention. The mineral acid most often used is hydrochloric acid because of its ready availability, low cost, and high effectiveness. Other mineral acids such as, for example, phosphoric acid, sulfuric acid, and the like, can also be used. Generally, at least 0.5% by weight of the mineral acid is required to effectively dissolve away the hard water and iron stains. It is most preferable, however, that the mineral acid be present in amounts which fall within the range of about 0.5 to 20% by weight of the composition.

The abrasive component of the cleaner compositions is most necessary for the purpose of physically scouring the stains from the surfaces. The abrasive agent should be present in amounts of from about 1 to 15% by weight of the composition. Any suitably acid stable abrasive agent may be used, although sand is preferred because of its ready availability and low cost. The abrasive agent particle size should be quite small, i.e., from about 40 to about 400 mesh (with a preferred size being from 140 to about 200 mesh). In such particle range, the abrasive is readily suspended in the homogenous stable liquid dispersion, yet the particles are large enough to provide adequate scouring properties. Other acid inert, abrasive agents such as, for example, kaolin, pumice, diatomite, tripoli, siliceous clay, etc., may be partially or completely substituted for the sand.

Sufficient water is added to the composition to bring the viscosity into the range wherein the thixotrope, upon being shaken, will sufficiently liquify to be easily squirted from the orifice of a container.

Additionally, various adjuvants, odors and the like may be added as is well known in the art. A dye may vary advantageously be added to the cleaner in sufficient quantity to impart a color thereto. Color may serve a very useful and distinct purpose other than making the cleaner more aesthetically pleasing. In particular, the color may indicate what portions of the object, for example, a toilet bowl, the cleaner has adhered to. Because of the adherent properties of the cleaner, the person making us of it will then know whether the stains within the bowl have sufficient cleaner adjacent them so that they may be effectively scrubbed. Suitable fragrances may also be added to the composition for the purpose of imparting a pleasing odor to the compositions.

In order to obtain a homogeneous stable thixotropic dispersion, the order of mixing the ingredients of the cleaner is important. In particular, the precipitated silica thixotropic agent is first mixed with the desired amount of water and the acid to form a dispersion. Agitation need not be severe, however good mixing, as by a propeller or similar type of stirrer, is carried out for a time sufficient to fully disperse the thickener in the water and acid. With stirring continued at a slower speed, the abrasive is then added to the thixotropic agent-water-acid dispersion and mixing is continued to make sure that a stable homogenous suspension is achieved. The other components, i.e., surfactant, dyes, perfumes, etc., are then mixed (at a slow speed to minimize foaming) into the dispersion to produce a stable, homogeneous composition.

TABLE I below sets forth some examples of a few suitable compositions according to the invention:

TABLE I

| ACID wt % | SURFACTANT wt % | THICKENING AGENT wt % | ABRASIVE* wt % | $H_2O$ wt % |
|---|---|---|---|---|
| HCl 8 | Neodol 25-3 0.25 | Zeothix ® 265 7.5 | Sand 10 | Balance |
| HCl 8 | Neodol 25-3 0.50 | Zeothix ® 265 7.5 | Sand 10 | " |
| HCl 8 | Neodol 91-5 0.25 | Zeothix ® 265 7.5 | Sand 10 | " |
| HCl 8 | Neodol 91-5 0.50 | Zeothix ® 265 7.5 | Sand 10 | " |
| HCl 8 | Neodol 45-13 0.25 | Zeothix ® 265 7.5 | Sand 10 | " |
| HCl 8 | Neodol 45-13 0.50 | Zeothix ® 265 7.5 | Sand 10 | " |
| HCl 8 | Triton X-100 0.25 | Zeothix ® 265 7.5 | Sand 10 | " |
| HCl 8 | Triton X-100 0.50 | Zeothix ® 265 7.5 | Sand 10 | " |
| HCl 8 | Bardac 2050 1.5 | Zeosyl ® 200 7.5 | Sand 10 | " |
| HCl 8 | Bardac 2050 0.25 | Zeothix ® 265 7.5 | Sand 5 | " |
| HCl 8 | Bardac 2050 0.25 | Zeothix ® 265 7.5 | Sand 10 | " |
| HCl 8 | Bardac 2050 0.50 | Zeothix ® 265 7.5 | Sand 5 | " |
| HCl 8 | Bardac 2050 0.75 | Zeothix ® 265 7.5 | Sand 5 | " |
| HCl 8 | Bardac 2050 0.75 | Zeothix ® 265 7.5 | Sand 10 | " |

TABLE I-continued

| ACID wt % | SURFACTANT wt % | THICKENING AGENT wt % | ABRASIVE* wt % | $H_2O$ wt % |
|---|---|---|---|---|
| 8 | 0.75 | 7.5 | 10 | |

The abrasive is a fine crystalline silica, i.e., quartz, tradenamed Supersil 140, available from Pennsylvania Glass and Sand Co. Also note that coloring pigments may be added to any of the formulations. For instance, a phthalogreen pigment may be added (less than 0.1%) to effectively color the product. No color change of the product was noted over a 60-day aging period.

Perfumes may also be added, e.g., several tenths of a percent, to effectively impart a desirable odor to the product.

Other formulations may be prepared according to the invention, so long as the various components fall within the classes and within the percentage limits noted herein.

In order to test the effect of different surfactants upon the syneresis of precipitated silica thickened formulations with 10% sand abrasive therein, a number of compositions were prepared and their syneresis was measured over a period of 84 days. TABLE II below sets forth the test results:

TABLE II

EFFECT OF VARIOUS SURFACTANTS ON THE SYNERESIS OF 7.5% ZEOTHIX 265, 10% SAND, 8% ACID SYSTEM

| SURFACTANT | DAYS AT AMBIENT TEMPERATURE 1 | 7 | 14 | 22 | 42 | 63 | 84 |
|---|---|---|---|---|---|---|---|
| | DEGREE OF SYNERESIS IN PERCENTAGE (%) | | | | | | |
| .25% Neodol 25-3 | 0 | 7 | 13 | 6 | 7 | 13 | 17 |
| .50% Neodol 25-3 | 0 | 4 | 4 | 3 | 0 | 10 | 10 |
| .25% Triton X-100 | 0 | 0 | 0 | 0 | 0 | 0 | 0 |
| .50% Triton X-100 | 0 | 0 | 0 | 0 | 0 | 0 | 0 |
| .50% Bardac 2050 | 0 | 3 | 0 | 1 | 0 | 0 | 4 |
| 1.0% Bardac 2050 | 0 | 3 | 0 | 0 | 0 | 0 | 0 |
| .25% Neodol 91-5 | 0 | 3 | 0 | 0 | 0 | 0 | 6 |
| .50% Neodol 91-5 | 0 | 3 | 0 | 0 | 0 | 0 | 0 |
| .25% Neodol 45-13 | 0 | 4 | 0 | 0 | 0 | 4 | 11 |
| .50% Neodol 45-13 | 0 | 1 | 0 | 0 | 0 | 0 | 6 |

[1]Defined as the percentage of watery layer above the suspension.

Further surprising results are shown upon consideration of TABLE III, below. TABLE III shows that if the examples of Sirine et al were followed, the desirable thixotropic and suspensory properties of the invention would not be attained. Examples 1–12 all depict that merely combining any proportion of silica with a relatively large amount of surfactant in Sirine et al leads unexpectedly to relatively *thin* products which have flocculated masses within their matrices. Further, these examples are incapable of successfully suspending abrasives (note: each example contains 8% hydrochloric acid and 10% sand). Also, the choice of precipitated silica must be carefully weighed, as shown in Examples 15–17, wherein Sipernat FK 500LS, a suspected medium structure precipitated silica, which is a replacement for Quso ® precipitated silica, is used. While syneresis values and suspending ability was satisfactory, viscosity was rather marginal. However, as shown in Examples 13–14, when the critical ranges of surfactant and silica are used, stable, suspending composition result. Surprisingly also, when subjected to advanced aging tests, these formulas do not deteriorate at 120° F.

for 1 week. The previous examples, on the other hand, either remained in their same, thin, syneretic and/or flocculated conditions, or worsened.

TABLE III

| TYPE OF SILICA | | SURFACTANTS | | SYNERESIS[3] | | VISCOSITY[4] | | |
|---|---|---|---|---|---|---|---|---|
| | | TRITON[1] | BARDAC[2] | | | CPS | CPS | |
| | | X-100 | 2050 | % | 120° F., | | 120° F. | |
| EXAMPLE | % | % | % | Same Day | 1 Week | Same Day | 1 Week | COMMENT[5] |
| (1) Sipernat 283LS[6] | 5.0 | 2.0 | 1.0 | 45 | 45 | c[7] | c[7] | Not acceptable due to |
| (2) Sipernat 283LS[6] | 6.0 | 2.0 | 1.0 | 37 | 37 | " | " | low viscosity and |
| (3) Sipernat 283LS[6] | 7.0 | 2.0 | 1.0 | 31 | 31 | " | " | excess syneresis |
| (4) Sipernat 283LS[6] | 8.0 | 2.0 | 1.0 | 22 | 22 | " | " | |
| (5) FK 500LS[8] | 5.0 | 2.0 | 1.0 | 23 | 23 | c[7] | c[7] | Excess syneresis |
| (6) FK 500LS[8] | 6.0 | 2.0 | 1.0 | 14 | 9 | 1,900 | 2,300 | Examples 6, 7 and 8 |
| (7) FK 500LS[8] | 7.0 | 2.0 | 1.0 | 8 | 8 | 3,100 | 3,300 | became very curdy with |
| (8) FK 500LS[8] | 8.0 | 2.0 | 1.0 | 3 | 5 | 9,900 | 5,900 | excess foaming upon aging |
| (9) Zeothix 265[9] | 5.0 | 2.0 | 1.0 | 35 | 35 | c[7] | c[7] | Not acceptable due |
| (10) Zeothix 265[9] | 6.0 | 2.0 | 1.0 | 31 | 34 | " | " | to low viscosity and |
| (11) Zeothix 265[9] | 7.0 | 2.0 | 1.0 | 12 | 20 | " | " | excess syneresis |
| (12) Zeothix 265[9] | 8.0 | 2.0 | 1.0 | 8 | 8 | " | " | |
| (13) Sipernat 283LS[6] | 8.0 | 0.4 | 0.2 | 3 | 0 | 9,900 | 14,000 | Examples homogeneous |
| (14) Zeothix 265[9] | 8.0 | 0.4 | 0.2 | 0 | 0 | 13,300 | 12,000 | and smooth flowing |
| (15) FK 500LS[8] | 8.0 | 0.4 | 0.2 | 8 | 8 | c[7] | c[7] | Examples became curdy |
| (16) FK 500LS[8] | 8.0 | 1.0 | 0.5 | 3 | 3 | 1,600 | " | and entrapped air upon |
| (17) FK 500LS[8] | 8.0 | 1.5 | 0.75 | 3 | 3 | 3,900 | 5,000 | aging |
| (18) Zeothix 265[9] | 5.0 | 0 | 2.5 | 16 | 50 | c[7] | c[7] | Example 18 became curdy |
| (19) Zeothix 265[9] | 6.0 | 0 | 2.5 | 16 | 14 | c[7] | c[7] | and extrapped air |
| (20) Zeothix 265[9] | 9.0 | 0 | 0.05 | 0 | 0 | 2,800 | 2,500 | upon aging |
| (21) Zeothix 265[9] | 9.0 | 0 | 0.15 | 0 | 0 | 10,000 | 8,000 | |
| (22) Zeothix 265[9] | 10.0 | 0 | 0.05 | 0 | 0 | 6,000 | 2,300 | |
| (23) Zeothix 265[9] | 8.0 | 0 | 0 | 7 | 7 | d[10] | d[10] | Failed to produce |
| (24) Zeothix 265[9] | 10.0 | 0 | 0 | 8 | 4 | d[10] | d[10] | acceptable product |
| (25) Zeothix 265[9] | 15.0 | 0 | 0 | 0 | 0 | d[10] | d[10] | Abrasive settled out |
| (26) Sipernat 283LS | 8.0 | 0 | 0 | 10 | 13 | d[10] | d[10] | immediately |

[1]Triton X - 100, a trademark of Rohm & Haas, is a t-octylphenoxy poly (ethyleneoxy) ethanol with 6.5 moles of ethylene oxide per mole of alcohol (nonionic surfactant).
[2]Bardac 2050, a trademark of Lonza Inc., is a 50% solution of alkyl ($C_8/C_{10}$-50%, $C_8/C_8$-25%, $C_{10}/C_{10}$-25%) dialkyl dimethyl ammonium chloride (cationic surfactant). Note surfactant level reported is for 100% solution so as to ensure accurate measurement.
[3]Defined as percentage of watery layer above the suspension.
[4]Measured with a Brookfield viscometer LVT Spindle T-D, equipped with a Helipath stand.
[5]Note: In each example, 8% by weight hydrochloric acid and 10% by weight sand were present.
[6]Sipernat 283LS, brand name for a precipitated silica made by a joint venture between Degussa, A.G. (West Germany) and P.Q. Corp.
[7]Viscosities of these samples are below 1000 cps. Due to substantial syneresis, viscosity values are not reliable and, therefore, not reported.
[8]FK 500LS, brand name for a precipitated silica made by a joint venture between Degussa, A.G. (West Germany) and P.Q. Corp.
[9]Zeothix 265, trademark of J. M. Huber Corp., is a very high structure precipitated silica.
[10]Each of these examples failed to suspend abrasive, which immediately sank to the bottom of the container. Even after stirring, rapid settling of abrasive occurred. Viscosity was so poor that these examples would not be considered acceptable for use.

The results disclosed in TABLE III should be evaluated very carefully as they highlight the reasons why the compositions of the invention are so surprising, and why consideration of the art would not teach the invention.

Examples 1 through 12 basically depict what occurs when *even the preferred* high structure precipitated silicas are combined with amounts of hydrogen bonding surfactant which *exceed* the critical upper limit of 2.5%. One would expect that combining precipitated silica with surfactant to make a thickened product simply requires adding first a given amount of the silica, and, if it is too thin, to add increasingly greater amounts of surfactant. Examples 1 through 12 show this assumption is false. Whether the amount of precipitated silica is below applicant's range (5%, which is also the high listed in the Sirine et al patent), or within the range, if the surfactant level *exceeds* 2.5%, a thin product results. Further extreme syneresis in some examples was also observed. This was completely unexpected at the lower level (5%), and it may be assumed that the level of silica is too low for thickening. At 6, 7, and 8% levels, however, unexpectedly, another phenomenon is believed to occur. While not wishing to be bound solely thereby, as other plausible explanations may arise, applicants speculate that increasing the level of surfactant in such a highly acidic medium may cause solids present in the suspension to agglomerate. Thus, no thickening is observed, but "curds" float listlessly about in the compositions. Of these 12 examples, Example 8, and more marginally, Example 7, appear to display adequate thickening and syneresis values, but they too, suffer from the clumped solids floating in the product.

On the other hand, where a *high* amount of very high structure precipitated silica (8%) is combined with surfactant which is less than the upper limit of 2.5% (Examples 13 and 14), excellent products were produced having virtually no syneresis and extremely good viscosities (10,000–14,000 centipoise) which stably suspended abrasives. Note also that all examples were aged for 1 week at 120° F. Examples 13 and 14 remained stable, continuing to show substantially the same excellent syneresis values, viscosities, and abrasive suspending abilities. Note also that combinations of nonionic and cationic surfactants work well together.

On the other hand, Examples 15–17 show that compositions with a somewhat less preferred precipitated silica may need more careful adjustment of its surfactant/silica ratio to provide a desirable product. Examples 15–17, however, at least show good syneresis values and suspend abrasives well.

Examples 18 through 26 are displayed to outline the boundaries of the critical levels of the precipitated silica and surfactant components of the invention.

Examples 19 and 18 may compare one of the inventive compositions with what might be argued is prior art. The 6.0% precipitated silica and 2.5% surfactant in Example 19 are right on the edge of, but still within, the critical levels claimed in this invention.

Example 19 shows extremely marginal viscosity, but does display acceptable syneresis values and suspends abrasives. Example 18, on the other hand, uses only 5% silica. The Sirine et al patent lists 5% as the top limit for silica in its formula. Example 18, which would be exemplary of a Sirine et al composition, had not merely unacceptable viscosity, but also poor syneresis, which, over time, increased more than 3 times (16 to 50%). This also clearly shows Sirine et al would not teach that adjusting levels of both surfactant and silica is critical.

Examples 19 through 22 show another extreme set of compositions of the invention whose levels of surfactant and silica also are on or close to the boundaries of the critical limits. Except for Example 19, perfectly acceptable compositions are produced in all areas. Example 19, while displaying rather marginal viscosity, nonetheless has good syneresis and will suspend abrasives.

Lastly, Examples 23 through 26 show that as the level of very high structure precipitated silica is increased, one cannot keep dropping the level of surfactant and pass the critical limit. No surfactant present caused these Examples to be unable to suspend abrasives.

As amply depicted in TABLE III, the levels of both surfactant and precipitated silica are critical, moreover, it is the relationship between these two components with respect to their critical levels which is crucial to the invention.

TABLE IV shows that some prior formulations using certain precipitated silicas whose compositional amounts adhered to the ranges disclosed in this invention and showed surprising continued stability even after two years. For example, Examples 27–29, which show acceptable syneresis and viscosity, were relatively stable over a two year period.

TABLE IV

Comparison of Precipitated Silicas Over a 2 Year Period

| EXAMPLE | INITIAL (3/26/82) VISCOSITY[1] | INITIAL (3/26/82) SYNERESIS[2] | FINAL (3/6/84) VISCOSITY | FINAL (3/6/84) SYNERESIS |
|---|---|---|---|---|
| 27 Quso ® G-32[3,4] | 4162 | 12% | 4800 | 14% |
| 28 Quso ® G-30[5,4] | 2950 | 11% | 2800 | 9% |
| 29 HiSil ® T-600[6,4] | 8490 | 5% | 9300 | 6% |

[1]Measured with a Brookfield LVT Viscometer equipped with a Helipath T-D spindle at 6 RPM. All samples were shaken prior to measurement.
[2]Defined as the percent of watery layer above the suspension.
[3]Quso ® G-32 was manufactured by P.Q. Corporation of Valley Forge, Pennsylvania.
[4]In all Examples, 27–29, the compositional percentages by weight were:

| | |
|---|---|
| HCl | 8.0% |
| Sipersil 140 (abrasive) | 10.0% |
| Bardac 2050 | 1.0% |
| Selected Silica | 7.5% |
| Water | Remainder |

[5]Quso ® G-30 was manufactured by P.Q. Corporation of Valley Forge, Pennsylvania.
[6]HiSil ® T-600 is manufactured by P.P.G. Industries, Inc., Baltimore, Maryland.

The figures of the drawing also disclose some examples of the compositions of the invention. Thus FIGS. 1 and 3 disclose compositions having 7.5% silica (Zeothix), 10% sand, and Bardac surfactant levels of 0.25%, 0.75%, 1.0% and 1.5%, respectively. Water constitutes the remainder. Such compositions are typical of the cleaners of the invention. However, variations of the components within the limits set forth above are also useful.

Figure 2:
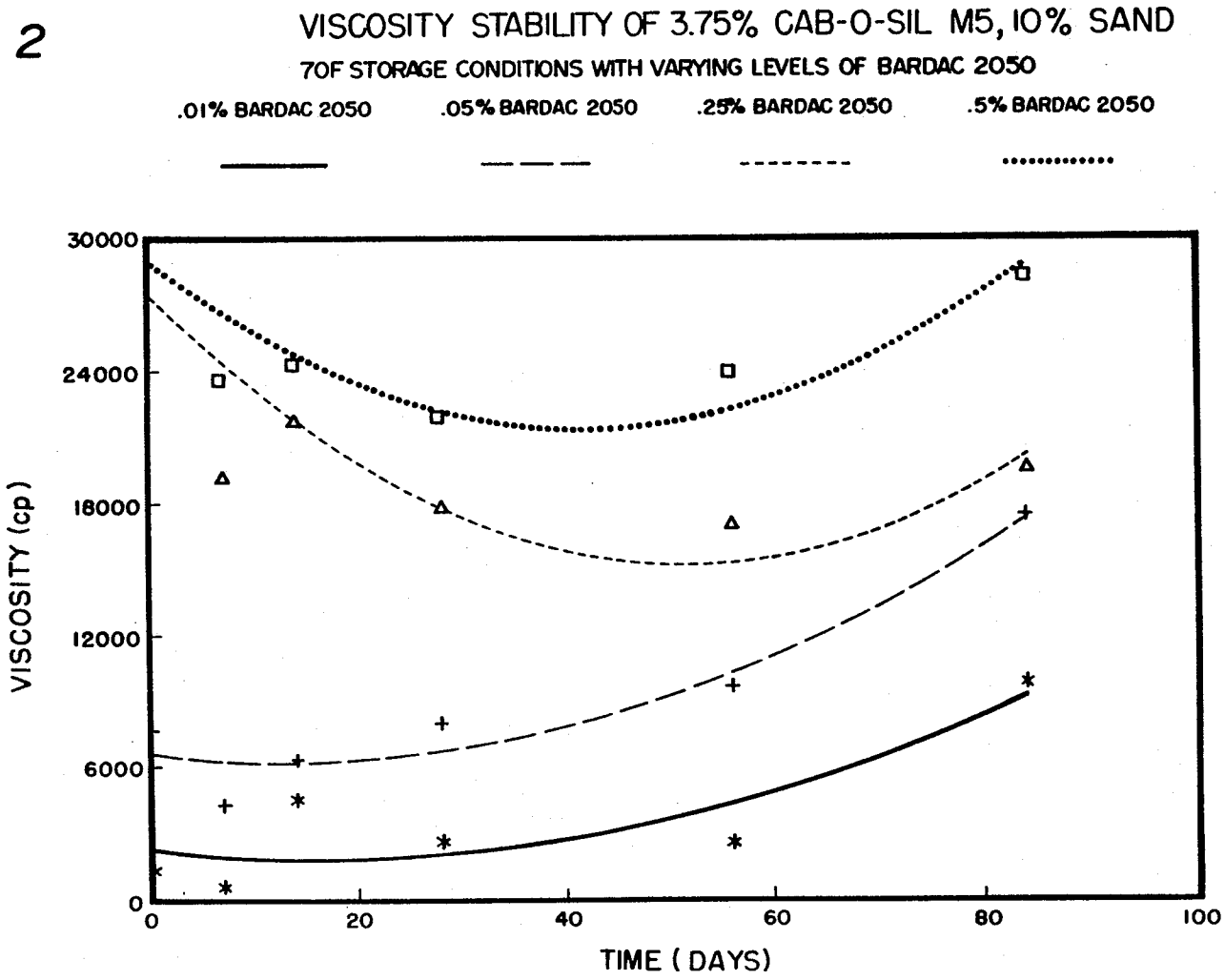
FIG. 2 is a graph illustrating the viscosity instability due to thickening with time and at 70° F. of a composition of fumed silica (Cab-O-Sil) thickening agent and 10% abrasive, in combination with varying amounts of the preferred quaternary surfactant.

The special ability of the very high structure precipitated silicas to produce compositions with a stable viscosity under varying conditions is illustrated in the figures which form a part of this specification. A comparison of FIGS. 1 and 2 will make it readily apparent that under identical storage conditions, i.e., 70° F., mixtures of the precipitated silica with the quaternary surfactant Bardac 2050 yielded compositions whose viscosity was extremely stable for periods of greater than 80 days. This stability is contrasted with that demonstrated by FIG. 2 wherein the identical quaternary surfactant mixed in various amounts with a fumed silica (Cab-O-Sil) demonstrated very highly fluctuating viscosities over the same time-period.

Figure 3:
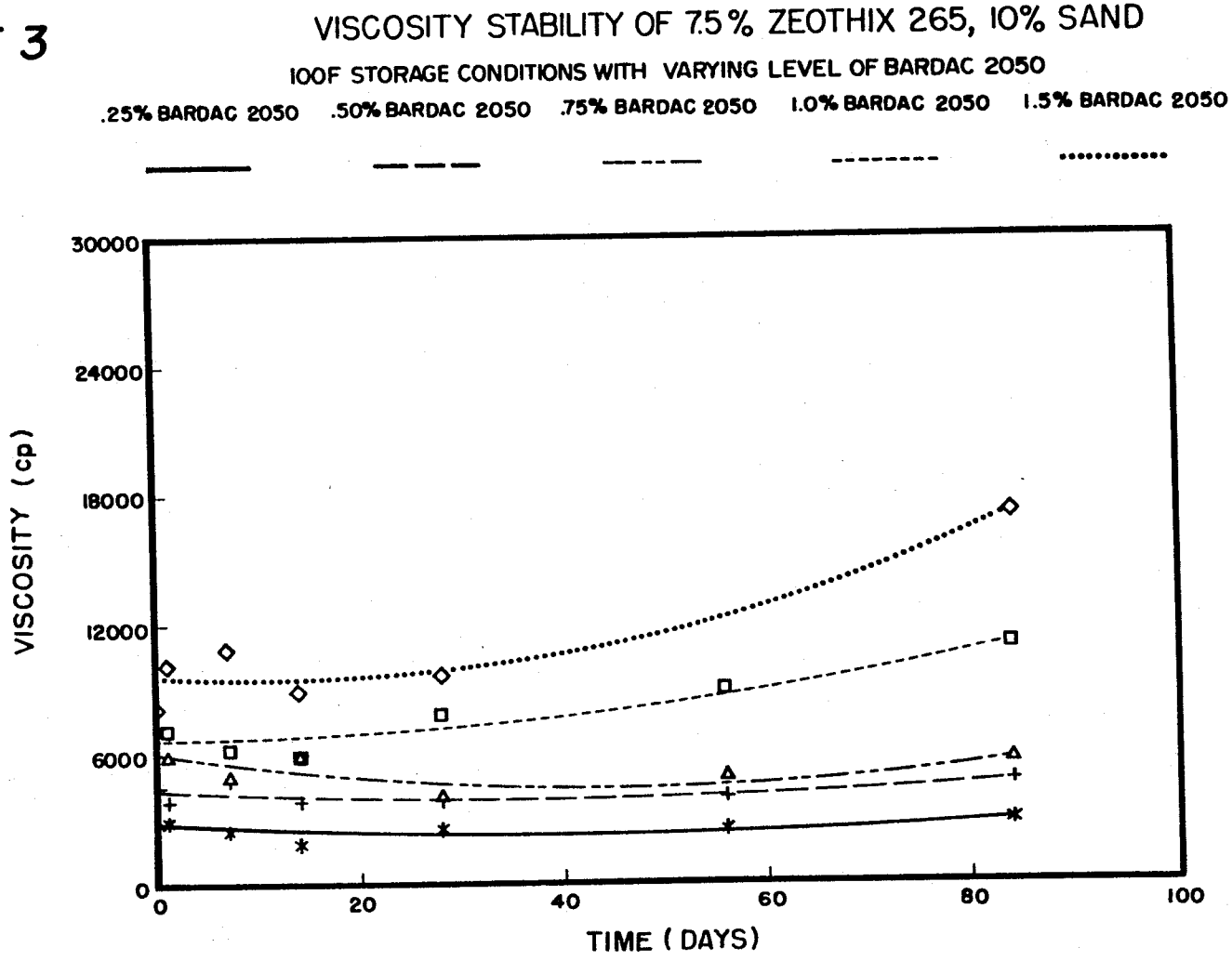
FIG. 3 is a graph illustrating the viscosity stability at 100° F. of compositions identical to those of FIG. 1.
Figure 4:
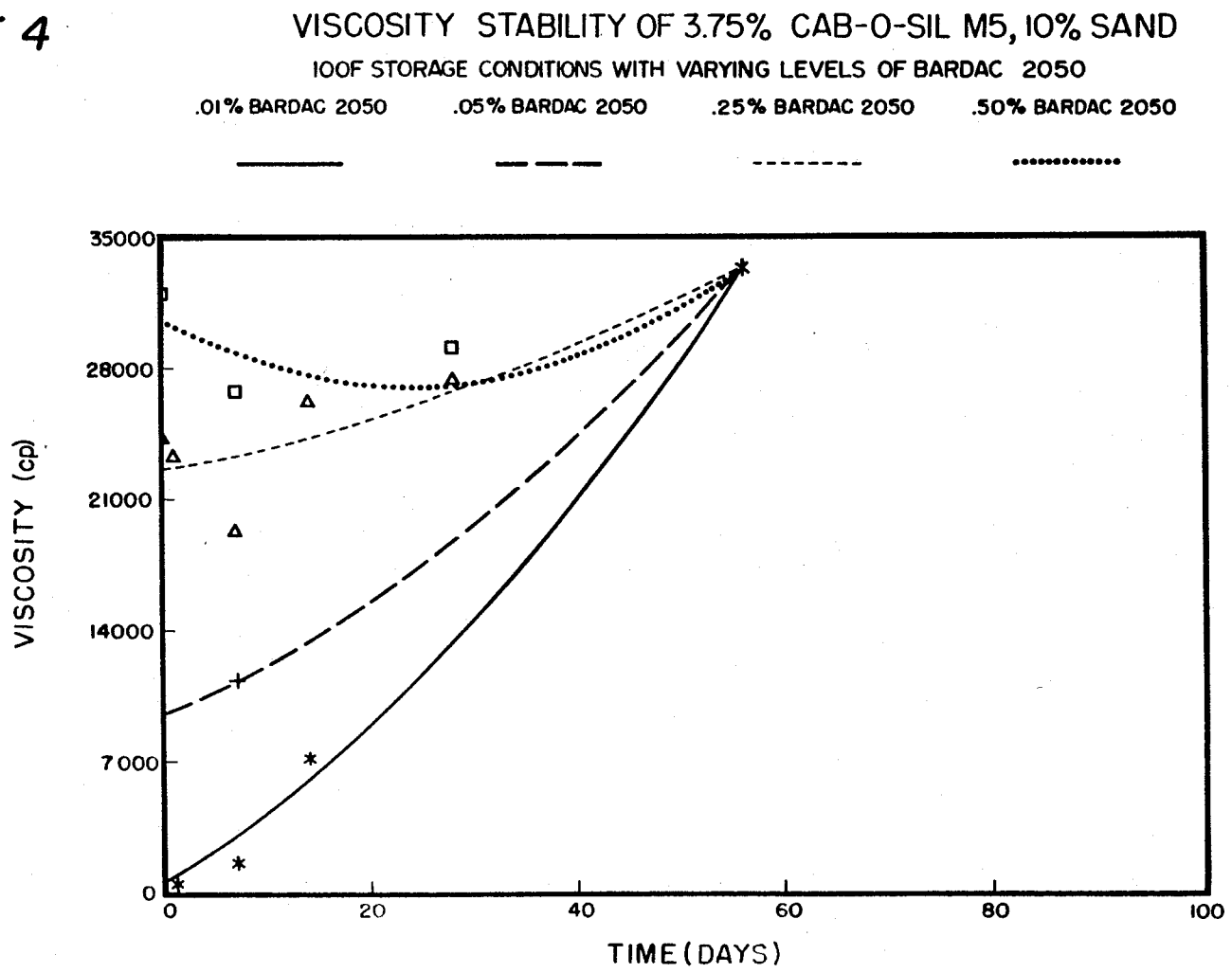
FIG. 4 is a graph illustrating accelerated viscosity instability at 100° F. of compositions identical with those of FIG. 2.

FIGS. 3 and 4 illustrate the same contrasts between quaternary surfactant stabilized with the precipitated silica in relation to the fumed silica compositions, except that the storage conditions were even more severe, i.e., at 100° F.

Figure 5:
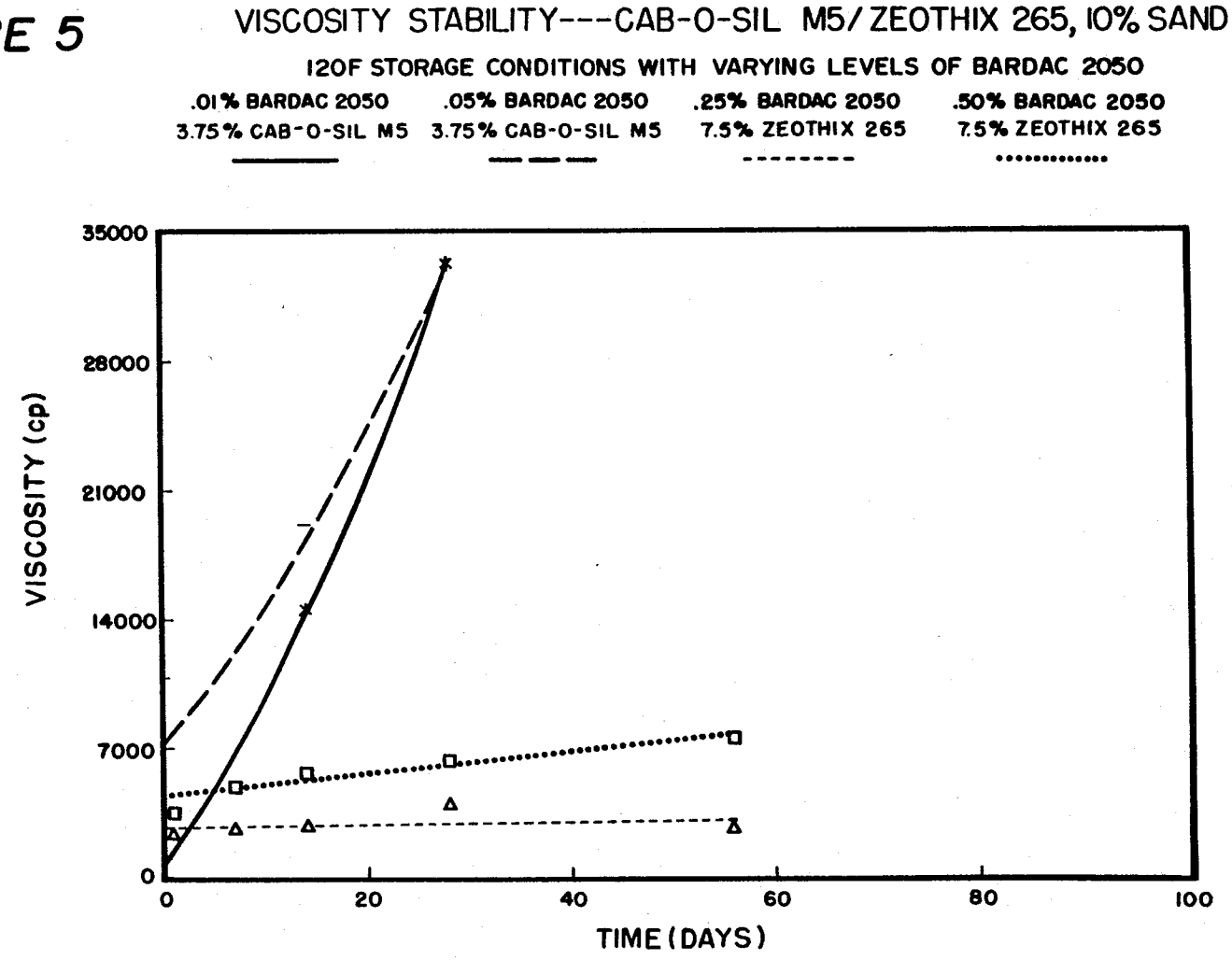
FIG. 5 is a graph comparing the viscosity stability at 120° F. of fumed silica (Cab-O-Sil M5) compositions, in contrast to precipitated silica (Zeothix ®265) in otherwise identical compositions including 10% abrasive in combination with varying amounts of the surfactant.

FIG. 5 dramatically illustrates the stability imparted to the cleaner compositions stabilized with precipitated silica (Zeothix 265) in contrast to those compositions stabilized with fumed silica (Cab-O-Sil M5) under relatively severe (120° F.) storage conditions.

Figure 6:
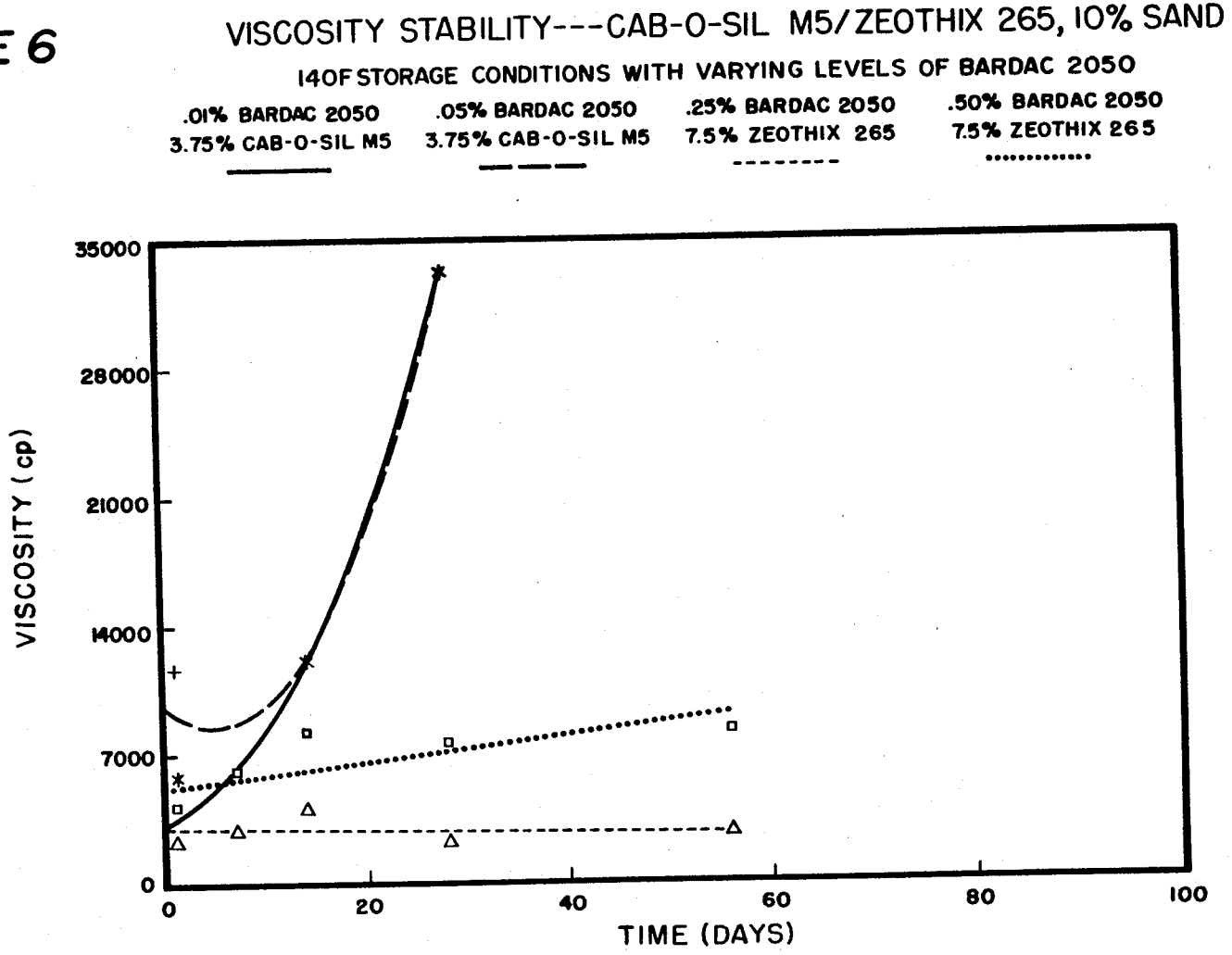
FIG. 6 is a graph similar to FIG. 5, comparing fumed silica compositions against precipitated silicas compositions, but at extremely severe (140° F.) temperature conditions.

FIG. 6 even more dramatically illustrates the ability of the precipitated silicas (Zeothix) to stabilize the viscosity of the cleaner compositions in contrast to the fumed silica compositions under even more severe (140° F.) storage conditions.

Thus, it is evident from the figures that the very high structure precipitated silicas have a dramatically effective ability to maintain the viscosity of the cleaner compositions over long periods of time under even the most severe temperature conditions.

The cleaner compositions of the invention are opaque thixotropic liquids. When applied to hard water stains or rust stains on hard surfaces, they exhibit an excellent ability to remove the same.

We claim:

1. A homogenous, thixotropic hard surface cleaner comprising about 0.05 to 2.5% of a cationic, nonionic, zwitterionic, or amphoteric surfactant, or mixtures thereof capable of hydrogen bonding, 6, to about 12% of a precipitated silica suspending agent, about 0.05 to 20% of an acid, an abrasive, and the remainder, water; wherein said cleaner stably suspends the abrasive while displaying minimal syneresis.

2. The cleaner of claim 1 wherein the precipitated silica is a very high structure precipitated silica.

3. The cleaner of claim 1 wherein the surfactant is cationic surfactant.

4. The cleaner of claim 1 wherein the surfactant is a nonionic surfactant.

5. The cleaner of claim 1 wherein the surfactant comprises a cationic surfactant and a nonionic surfactant.

6. The cleaner of claim 3 wherein said cationic surfactant is a quaternary ammonium salt.

7. The cleaner of claim 1 wherein the acid is a mineral acid.

8. The cleaner of claim 7 wherein the mineral acid is hydrochloric acid.

9. The cleaner of claim 1 wherein the abrasive is sand.

10. The cleaner of claim 1 wherein the abrasive is present in an amount from about 1 to 15% by weight of the composition.

11. The cleaner of claim 1 wherein a coloring agent and a fragrance are present in minor amounts.

12. The cleaner of claim 1 wherein the surfactant is a quaternary ammonium salt present in about 0.25 to 1.0% by weight; the acid is hydrochloric acid present in about 0.5 to 20% by weight; the abrasive is finely divided sand present in about 1 to 15% by weight; the precipitated silica suspending agent is present in about 7 to 8.5% weight; and the remainder is water.

13. The cleaner of claim 1 wherein the cleaner has a viscosity of about 4,000 to 20,000 centipoise.

14. The cleaner of claim 1 wherein the syneresis of the cleaner is no greater than 20%.

15. The cleaner of claim 1 wherein said precipitated silica is selected from the group consisting essentially of: Zeothix ®265, HiSil ®T-600, Sipernat ®283LS, FK 500LS; Quso ®G-32; Quso ®G-30, Zeosyl ®200, Silcron G-100 and Syloid ®FP 244.

16. A method of preparing a homogenous, thixotropic hard surface cleaner comprising combining:

about 0.05 to 2.5% of a hydrogen bonding cationic, nonionic, zwitterionic, or amphoteric surfactant, or mixtures thereof, no less than 6, to about 12% of a precipitated silica suspending agent, about 0.05 to 20% of an acid, an abrasive, and the remainder, water; wherein said cleaner stably suspends the abrasive while displaying minimal syneresis.

17. The method of claim 16 wherein said surfactant is a cationic, nonionic surfactant, or mixtures thereof.

* * * * *